United States Patent [19]

Leischer

[11] Patent Number: 4,571,859

[45] Date of Patent: Feb. 25, 1986

[54] NOTCHED DITCHER CHAIN TOOTH

[76] Inventor: Douglas A. Leischer, Box 375, Pierre, S. Dak. 57501

[21] Appl. No.: 689,558

[22] Filed: Jan. 7, 1984

[51] Int. Cl.[4] ..... E02F 9/28

[52] U.S. Cl. ..... 37/191 A; 37/142 R

[58] Field of Search ..... 37/191 A, 192 A, 142 R, 37/142 A, 141 T; 83/830–835

[56] References Cited

U.S. PATENT DOCUMENTS

| | | | |
|---|---|---|---|
| 1,333,394 | 3/1920 | Ekman | 37/142 R |
| 1,395,048 | 10/1921 | McKee | 37/142 R |
| 2,925,673 | 2/1960 | Sennholtz | 37/142 R |
| 3,022,588 | 2/1962 | Brown | 37/191 A |
| 3,149,679 | 9/1964 | Johnson et al. | 37/142 R X |
| 3,297,365 | 1/1967 | Proctor | 37/142 A X |
| 4,028,823 | 6/1977 | Edwards et al. | 37/142 R |
| 4,187,626 | 2/1980 | Greer et al. | 37/142 R X |

*Primary Examiner*—Clifford D. Crowder

*Attorney, Agent, or Firm*—Harvey B. Jacobson

[57] ABSTRACT

The forwardly and outwardly inclined marginal edge of a conventional "cupped" ditcher chain tooth is provided with an elongated longitudinally extending shallow notch including front and rear ends spaced generally one-third the length of the tooth outer marginal edge from the front and rear ends of the tooth. The notch is of a length slightly less than one-third the length of the tooth outer marginal edge and the depth of the notch is between one-quarter and one-third the length of the notch.

8 Claims, 5 Drawing Figures

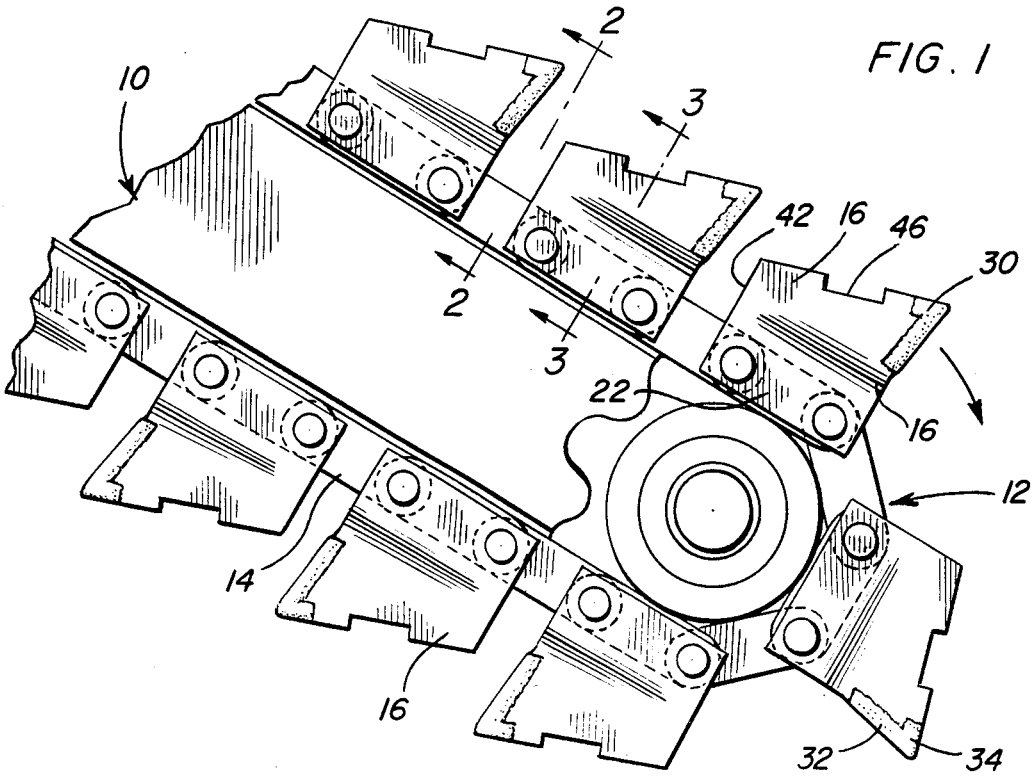
FIG. 1
FIG. 2
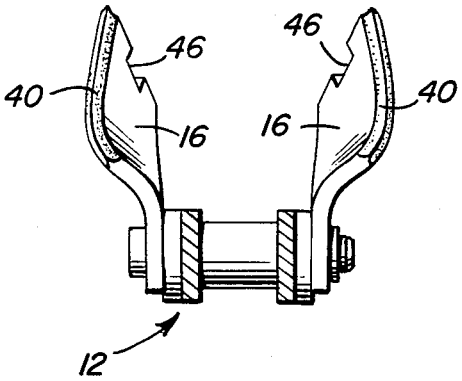
FIG. 4
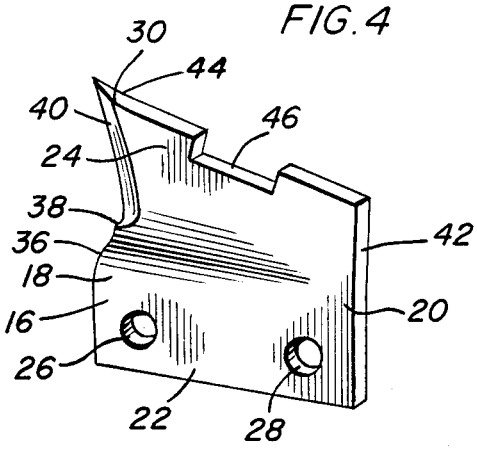
FIG. 3
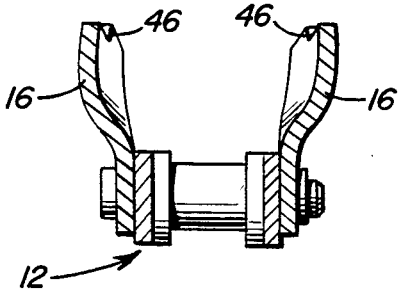
FIG. 5
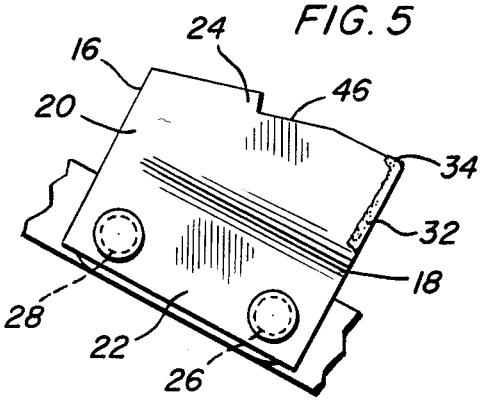

NOTCHED DITCHER CHAIN TOOTH

BACKGROUND OF THE INVENTION

1. Field of the Invention

This invention relates to a cupped-type ditcher tooth for use on chain-type ditchers. The tooth includes a hardened leading working edge, as is conventional, and the outer edge of the tooth is inclined rearwardly and inwardly toward the center line of the associated chain and includes an elongated notch formed therein and extending therealong intermediate the front and rear ends of the outer edge.

The tooth is conventional except for the provision of the afore-mentioned notch. The provision of such a notch prevents the forward corner of the tooth as defined by the intersection of the outer extremity of the forward working edge and the forward extremity of the outer edge from becoming excessively rounded. If the forward corner becomes excessively rounded, it has a tendency to skid over and cam the forward outer corner of the tooth away from the earth being dug.

2. Description of Related Art

Various different forms of ditcher chain teeth heretofore have been provided such as those disclosed within U.S. Pat. Nos. 1,286,008, 2,569,066, 2,946,142, 3,153,867, 3,593,804 and 4,363,178. However, these previously known forms of ditcher chain teeth are not of the cupped-type and have not been specifically designed to substantially eliminate excessive rounding of the outer forward corner portion of a cupped ditcher chain tooth.

SUMMARY OF THE INVENTION

The ditcher chain tooth of the instant invention comprises, generally, a conventional cupped-type ditcher chain tooth, but a tooth which has been modified by the provision of an elongated longitudinally extending and outwardly opening notch formed in the outer edge of the tooth centrally intermediate the front and rear ends of the tooth outer edge.

The notch provided in the tooth outer edge serves to prevent the hardened and sharpened leading outer corner of the tooth from becoming excessively rounded as the outer corner gradually wears away. Excessive rounding of the leading outer corner of the tooth considerably reduces the cutting ability of the tooth to the extent that it tends to merely ride over the ground being dug as opposed to cutting through the ground.

The main object of this invention is to provide a ditcher chain tooth of the cupped-type which will be capable of efficient digging operation for a greater length of time until replacement of the tooth is required.

Another object of this invention is to provide a ditcher tooth constructed in a manner whereby efficient digging action by the tooth is maintained substantially throughout the entire useful life of the tooth.

Another object of this invention is to provide a ditcher tooth which is conventionally formed and need only be constructed to incorporate one simple additional structural feature over a conventional ditcher tooth in order to perform in the intended improved manner.

Yet another object of this invention is to provide an improved form of ditcher tooth incorporating improved operational features thereof enabling ready modification of existing ditcher teeth in accordance with the present invention.

A final object of this invention to be specifically enumerated herein is to provide a ditcher tooth in accordance with the preceding objects and which will conform to conventional forms of manufacture, be of simple construction and dependable in operation so as to provide a device which will be economically feasible, long lasting and relatively trouble free.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a fragmentary side elevational view of a ditcher incorporating a ditching chain including cupped digging teeth constructed in accordance with the present invention;

FIG. 2 is a transverse sectional view taken substantially upon the plane indicated by the section line 2—2 of FIG. 1;

FIG. 3 is a transverse sectional view taken substantially upon the plane indicated by the section line 3—3 of FIG. 1;

FIG. 4 is a perspective view of a conventional cupped ditcher tooth; and

FIG. 5 is a side elevational view of a partially worn ditcher tooth constructed in accordance with the present invention.

DESCRIPTION OF THE PREFERRED EMBODIMENT

Referring now more specifically to the drawings, the numeral 10 generally designates a trenching boom of a trencher 12 and about which a trenching chain 14 is guidingly supported and longitudinally advanced. The chain 14 includes right- and left-hand teeth 16 constructed in accordance with the present invention.

The right- and left-hand teeth 16 are identical except for being mirror images of each other. From FIGS. 2, 3 and 4 of the drawings, it may be seen that each tooth 16 includes front and rear marginal portions 18 and 20, an inner marginal portion 22 and an outer marginal portion 24. The inner marginal portion 22 is substantially planar and has a pair of front and rear transverse bores 26 and 28 formed therethrough whereby the tooth 16 may be operably connected in the chain 14 in the conventional manner and it will be noted that the outer marginal portion 24 is rearwardly and inwardly inclined toward the rear end of the tooth 16 and that the outer and forward ends of the forward marginal portion 18 and outer portion 24 intersect to form a forward outer corner portion 30 defining an included angle of slightly less than 90°. Further, the outer end of the forward marginal portion 18 is hardened as at 32 and the forward end of the outer marginal portion 24 is hardened as at 34.

The tooth 16 comprises a "cupped tooth" and it may be seen that the forward marginal portion 18, at its inner end, is substantially straight, and that the outer end of the marginal portion is sharply laterally outwardly curved as at 36 and thereafter more gradually inwardly curved as at 38. The outer end portion of the forward marginal portion 18 is bevelled as at 40 to define a sharpened edge. The inner end of the rear marginal portion is substantially straight and coplanar with the inner marginal portion 22 and the outer end of the rear marginal portion 20 is slightly laterally outwardly inclined as at 42. Because of the cupped configuration of the tooth 16, the outer marginal portion 24 is slightly fowardly and laterally outwardly inclined from the rear marginal portion 20 to the corner portion 30 and the corner portion 30 is slightly outwardly flared as at 44.

The foregoing comprises a description of a conventional form of "cupped" ditcher chain tooth. The chain tooth 16 differs from a conventional chain tooth in that the outer marginal portion 40 is provided with elongated longitudinally extending and an outwardly opening notch 46. The length of the notch 46 along the outer marginal portion 24 is slightly less than one-third the length of the outer marginal portion 40 and is spaced slightly more than one-third the length of the outer marginal portion 24 from the forward extremity thereof. Further, the depth of the notch 46 is between one-fourth and one-third the length of the notch.

The provision of the notch 46 in the otherwise conventional tooth 16 comprises the instant invention. Depending upon the type of soil being dug, digging equipment incorporating teeth 16 provided with notches 46 may be operative to dig a trench as much as eight times as long as the same digging equipment provided with conventional teeth of the same type but not including the notch 46. In addition, the digging rate of a ditcher equipped with notched teeth is faster with worn notched teeth than the digging rate of a ditcher equipped with similarly worn unnotched teeth.

It is to be noted that the chain 24, while being illustrated as including only outside right- and left-hand teeth 16, actually may include not only outside right- and left-hand teeth 16 but also inside right- and left-hand 16, with all teeth 16 being identically formed. The outside teeth have a tendency to wear most at the center of the cupped portion of the forward marginal portion 18 while the inside teeth tend to wear most at the forward outer corner portion 30. It is the inner teeth whose corner portions 30 tend to become excessively rounded.

Although it may be difficult to understand why the formation of the notches 46 in the outer marginal portions 24 prevent the forward corner portion 30 from being excessively rounded and instead cause the outer marginal portion 24 to wear in the manner illustrated in FIG. 5 of the drawings to maintain a generally 90° forward corner portion, as the center or inner teeth cut into and across the ground being dug the tooth has a tendency to be slightly cocked and the center teeth perform not only a cutting action but also a scooping action on the loose dirt within the trench. By forming the notches 46 in the outer marginal portions 24, the forward corner portions 30 wear more quickly but in the manner illustrated in FIG. 5 to maintain a substantially 90° forward corner portion as opposed to an excessively rounded forward corner portion.

By establishing this more rapid wear and improved wear pattern, notched inner teeth perform the desired cutting action in the soil at substantially the same rate until such time as the teeth are excessively worn down. Unnotched inner teeth, on the other hand, do not wear down as rapidly but experience excessive rounding of the corner portions 30 thereof. This reduces the cutting action of the center teeth on the soil being dug to a substantially non-existent rate and the camming action of the excessively rounded corner portions 30 of the center teeth prevents the outer teeth from carrying out their part of the digging action. It is further pointed out that unnotched inner teeth must be discarded when they become excessively rounded and that such discarded center teeth have considerably more tooth material left than notched center teeth which have been worn to and beyond the extent illustrated in FIG. 5.

By providing the notches 46, the hardened portions 32 and 34 of the center teeth wear in the manner illustrated in FIG. 5 without excessive rounding and thus are able to continue effective cutting action until such time as an insufficient amount of tooth materials remains. Further, it is pointed out that the position of the notch 46 may be shifted slightly rearwardly when the ground to be dug is relatively hard and shifted slightly forwardly when the ground to be dug is relatively soft.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A ditcher chain tooth for use, in right- and left-hand configuration, on opposite sides of a ditcher chain, said tooth being of the cupped-type and including a plate member having opposite inner base and outer free marginal portions as well as front and rear marginal portions extending between corresponding front and rear ends of said inner and outer marginal portions, said inner marginal portion being substantially planar and defining a medial plane, the front marginal portion, extending from said inner marginal portion toward said outer marginal portion and initially abruptly curving outwardly of one side of said plane and thereafter more gradually curving inwardly toward said plane, said rear marginal portion, outwardly of said inner marginal portion, being slightly angled outwardly of said one side of said plane toward said outer marginal portion, said outer marginal portion being slightly forwardly and outwardly inclined to said one side of said plane and forwardly and upwardly inclined away from said inner marginal portion, said outer marginal portion including an elongated outwardly opening notch formed therein spaced generally one-third of the length of said outer marginal portion from both the front and rear ends of said outer marginal portion.

2. The tooth of claim 1 wherein said outer marginal portion, forward of said notch flares slightly outwardly away from said plane.

3. The ditcher chain tooth of claim 1 wherein said notch includes front and rear edges disposed generally normal to said outer marginal portion and a bottom surface generally paralleling said outer marginal portion.

4. The tooth of claim 1 wherein said notch is of a length slightly less than one-third the length of said outer marginal portion.

5. The tooth of claim 4 wherein the depth of said notch is between one-fourth and one-third the length of said notch.

6. In a cupped ditcher chain tooth of the type including inner and outer marginal edges, front and rear marginal edges and a forwardly and outwardly inclined outer marginal edge intersecting at its forward end with the outer extremity of the forward marginal edge, said front marginal edge extending from said inner marginal edge toward said outer marginal edge and initially abruptly curving outwardly to one side of said tooth and thereafter more gradually curving inwardly, the improvement comprising a shallow elongated notch formed in said outer marginal edge with the opposite ends of said notch spaced generally one-third the length of said outer marginal edge from the front and rear ends thereof.

7. The tooth of claim 6 wherein said notch includes opposite end edges disposed generally normal to said outer marginal edge and a bottom surface generally paralleling said outer marginal edge.

8. The method of modifying a cupped ditcher chain tooth for improving the forward outer corner wear characteristics thereof and wherein said tooth includes a generally straight rearwardly and inwardly inclined outer marginal edge, said method including the formation of an elongated outwardly opening notch in said outer marginal edge centrally intermediate the front and rear ends thereof and with said notch being of a length generally equal to one-third the length of said outer marginal edge.

* * * * *